US006640342B2

(12) United States Patent
Dixon

(10) Patent No.: US 6,640,342 B2
(45) Date of Patent: Nov. 4, 2003

(54) HAT AND SCARF COMBINATION AND METHOD OF WEARING SAME

(76) Inventor: Lisamarie Dixon, 73 E. 2nd St., Apt. 2, New York, NY (US) 10003

( * ) Notice: Subject to any disclaimer, the term of this patent is extended or adjusted under 35 U.S.C. 154(b) by 0 days.

(21) Appl. No.: 09/783,051

(22) Filed: Feb. 14, 2001

(65) Prior Publication Data

US 2002/0108164 A1 Aug. 15, 2002

(51) Int. Cl.[7] ..... A42B 19/02
(52) U.S. Cl. ..... 2/171; 2/207
(58) Field of Search ..... 2/171, 202, 203, 2/205–208, 209.11

(56) References Cited

U.S. PATENT DOCUMENTS

| | | | | | |
|---|---|---|---|---|---|
| 2,831,197 | A | * | 4/1958 | Spells | 2/207 |
| 5,007,115 | A | * | 4/1991 | Denbow et al. | 2/208 |
| 5,621,920 | A | * | 4/1997 | Gorsuch et al. | 2/195.8 |
| 5,621,921 | A | * | 4/1997 | Outland | 2/207 |
| 5,822,800 | A | * | 10/1998 | Anderson | 2/202 |
| 6,026,514 | A | * | 2/2000 | Fricker | 2/209.11 |
| 6,175,964 | B1 | * | 1/2001 | Adler | 2/207 |

OTHER PUBLICATIONS

Printout of web page of Broadway Sun Ben showing S0–020 Ladies Polyester Multi–Usage Scarf, dated Jan. 19, 2001.

Copy of advertisement of Signatures ® showing #12–68808–1 Warm Hooded Scarf, not Dated.

Copy of catalog page of D.R. Leonards showing #96263 etc. "Fur" Hat and Scarf, not Dated.

Copy of catalog page of Bright–Life showing #11862 etc. Fashion Hat with Wrap–Around Scarf.

Copy of advertisement of Starcrest of California for Stock No. 11–59143–5 Hooded Scarf, not dated.

* cited by examiner

*Primary Examiner*—John J. Calvert
*Assistant Examiner*—Katherine Moran

(57) ABSTRACT

A tubular hat and scarf combination garment with the appearance and functionality of a standard wrap around scarf that may alternately be used solely as a scarf, solely as a hat, or as a hat and scarf combination covering the head, neck chest and face or a combination thereof. The preferred embodiment is essentially a piece of fabric that is doubled-over onto itself with the two long ends of the fabric connected. Both tube ends are sized to fit over the head. Another embodiment of the hat and scarf combination garment and methods of wearing the same has a pair of hat members located at the opposite ends of the garment, and a "solid" fabric member running therebetween. Another embodiment of the hat scarf combination would include a fastening mechanism to secure the body of the garment to the hat portion in the desired fashion.

5 Claims, 4 Drawing Sheets

HAT AND SCARF COMBINATION AND METHOD OF WEARING SAME

BACKGROUND OF THE INVENTION

This invention relates to head and neck wear, specifically to a garment that may function as a scarf or as a hat or as a hat and a scarf combination, along with a method of so using the item.

Clearly, hats and scarves are old in the art. To some degree, it is also old in the art to have a hat and a scarf working in combination, to form and be used as a single garment.

Such earlier hat and scarf combinations consisted primarily of standard looking hat elements having extending at the back thereof two separate long flowing pieces of fabric, which long flowing pieces of fabric could then be used as a scarf, and thereby wrapped around the hat wearer's neck and or lower face. The hat elements of these earlier hat and scarf combinations, could be in the shape of a standard knit caps or fancier fur hats. In any event, the ultimate design feature of the scarf element was the same for all of these prior art hat/scarf combinations; two pieces of fabric extending downward from opposite sides of the back of the hat. These hat scarf combination garments were worn by first placing the hat element on the top of the head, and then individually wrapping and/or tying the two downwardly extending "scarf" elements around the neck and/or lower face; as one would with a regular scarf.

Another type of prior art hat/scarf combination were of the "hooded scarf" construction. With these types of prior art constructions, a scarf would have extending there through, somewhere in the middle length of fabric, an opening for receipt of a person's head. Once the head was inserted through the opening, extra fabric extending up from the scarf, would then extend over the person's head to be worn in the manner of a hood. The method of wearing the "hooded scarf" combination, was to insert the head through the hood opening in the middle of the scarf, adjust the hood on the head and then wrap the scarf elements (here again there are two), around the lower neck and/or face.

Another type of prior hat/scarf combination were of the long tailed knitted cap construction. With these types of prior art constructions a knit cap would have a long tail extending from the top of the garment which could be wrapped around the neck. The method of wearing long tailed knitted cap was to place the cap on the head and then wrap the tail around the neck.

Yet other types of prior art hat/scarf combinations are those in the form of a tubular piece of fabric having an opening extending throughout the length of the fabric. Once the head was inserted through the entire tube of the fabric, one tube end could be pulled up over the back and top of the head leaving the face of the wearer protruding from the interior of one tube end, with the balance of the fabric encircling the neck, and the opposite tube end resting on the shoulders. These items are similar to a bodiless and sleeveless turtleneck having a head covering element, as they cannot be extended in any direction, nor unwrapped and adjusted like a traditional scarf. The method of wearing the tubular hat/scarf combinations was to slip the head through the continuously running, central opening, and pull the garment up over the head like a hood. The hood could be pulled up over or off the head but there was little or no adjustability around the neck as the garment could not be completely opened, it simply rested on the shoulders unless it was entirely removed.

Accordingly, it would be desirable to provide a hat scarf combination garment that first functions and appears as a standard wrap around scarf yet is multi-functional and may easily be adjusted to changes in temperature. Such a garment does not have the standard form of a hat and two long flowing pieces of fabric hanging therefrom; it is not in the nature of a "hooded scarf"; it is not in the form of a knitted cap with a long tail; nor is it such that an entire tube of fabric must be pulled over the head, or off the head on to the neck, leaving the fabric bunched on top of the shoulders in a disadvantageous and mostly un-adjustable position. Instead, it would be desirable that the hat and scarf combination garment would be very similar in looks and size and function to a standard scarf, and could be worn as such, but made in a tubular type fashion (similar to the earlier discussed prior art tubular items), allowing it to alternately be worn by placing one of the tubular ends over the top of the head, as a hat would be worn, and then wrapping, if the wearer so chooses, the remaining single fabric length portion of the item in a scarf-like manner around the neck, chest, face or a combination thereof.

SUMMARY OF THE INVENTION

In accordance with the invention, an improved hat and scarf combination and alternate methods of wearing the same, is provided. The garment is essentially of tubular construction; a piece of fabric doubled over onto itself, with the two long ends of the fabric being connected together. With this construction a tubular opening is rendered throughout the interior of the fabric, along the length of the garment. The length of the garment is long enough to accommodate receipt over the top of the head (like a regular hat) at one end of the tubular garment, leaving enough length to then be wrapped around, at least once, the neck, chest and face area, as desired, in the manner of a standard scarf. Alternately, the garment made be worn solely as, and look very similar to, a standard scarf, or solely as a hat with a long tail.

Accordingly, it is an object of the invention to provide an improved hat and scarf combination garment, and improved alternate methods of wearing the same. The fabric member of the improved hat and scarf combination garment may be made of any known textile, synthetic, or natural material or any combination thereof.

Still another object of the invention is to provide an improved hat and scarf combination garment in the form of a long tubular piece of fabric that largely appears and may function in a standard scarf manner yet comprises additional unobvious uses; either end of the tubular garment may be worn on top of the head like a hat, leaving the remaining portion of the length of fabric to extend downwards from the head that provides the option of being wrapped around the lower face, neck and chest areas, in a scarf type manner.

Yet another embodiment of the invention is to provide an improved hat and scarf combination garment having a securing mechanism to hold the garment around the wearer's neck and head. The securing mechansims may be hooks and eyes, snaps, or buttons.

It is anticipated that any method of constructing a primarily symmetrical hat/scarf garment with receptacles for a person's head at either end is anticipated herein.

Other objects of the invention will in part be obvious and will in part be apparent from the following description.

The invention accordingly comprises an assembled construction and method of wearing possessing the features, properties, relation of components and steps which will be exemplified in the products and methods hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
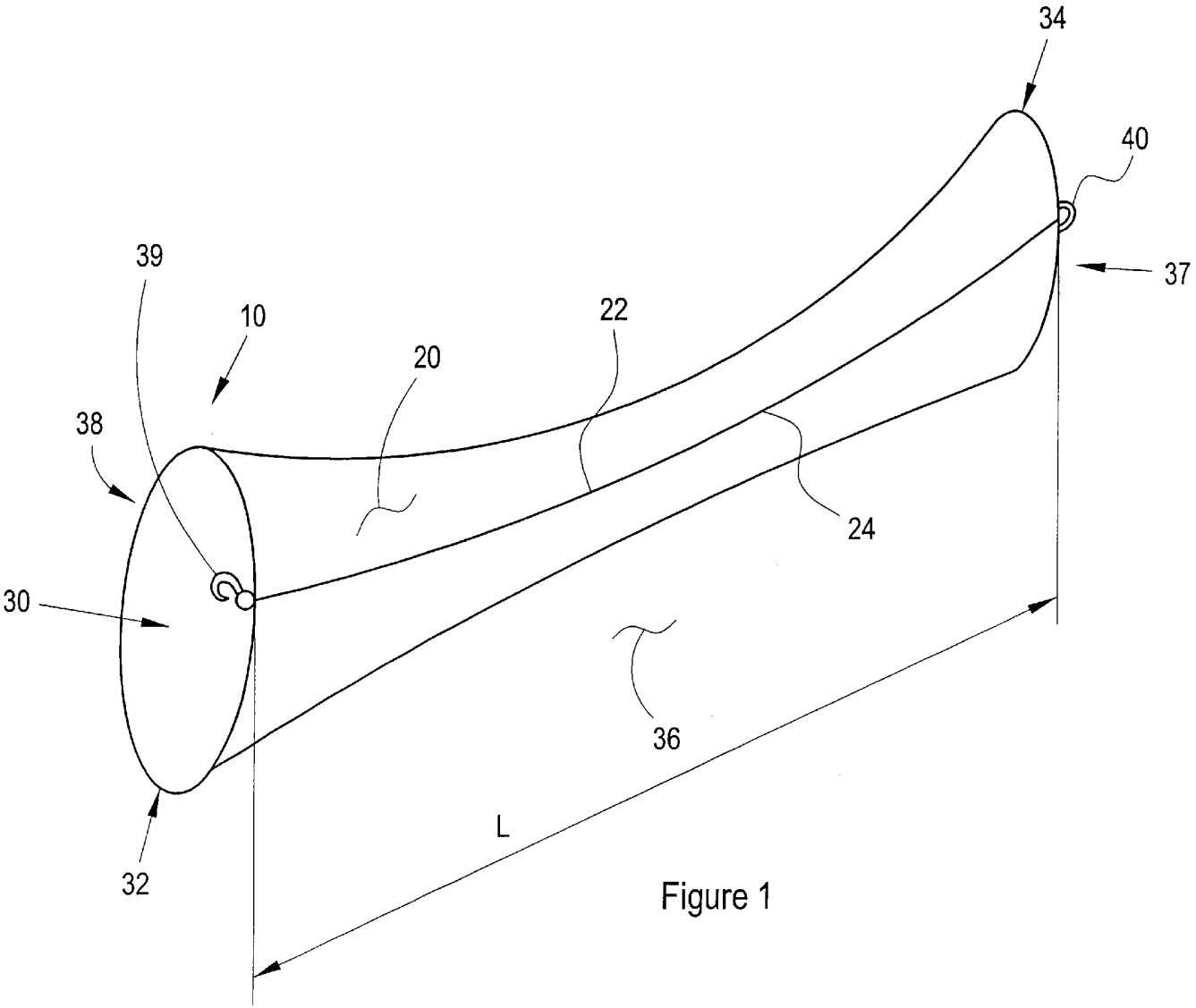
FIG. 1 is a perspective view of an embodiment of the invention.

Referring first to FIG. 1, the tubular shaped construction of the hat and scarf combination garment is shown at 10. Here, a fabric 20 is seen to be connected together along its length defining edges 22 and 24, in order to form tubular member 10.

Figure 4:
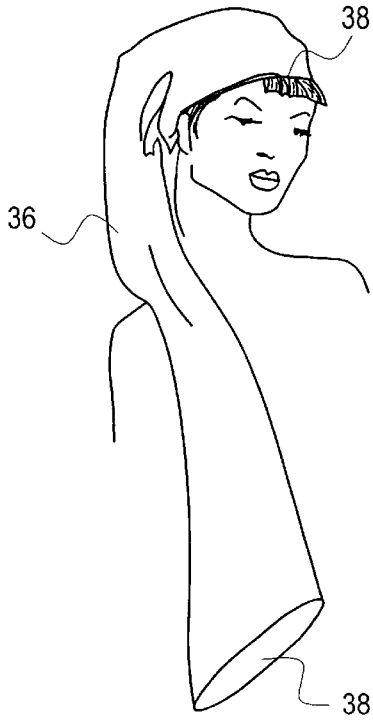
FIG. 4 is a front view of a person wearing the embodiment solely as a hat.
Figure 5:
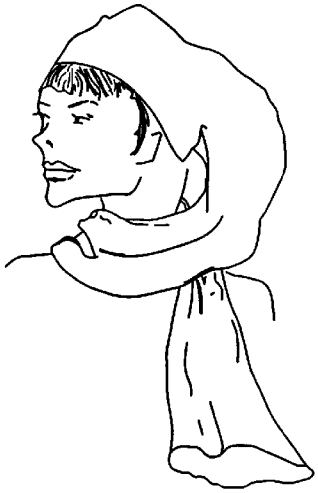
FIG. 5 is a profile view of a person wearing the embodiment similarly to a hat and traditional scarf covering the head, neck and chest.
Figure 6:
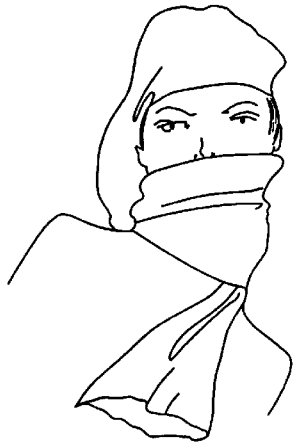
FIG. 6 is a front view of a person wearing the embodiment as hat and scarf combination covering the head, lower face, neck and chest.

Tubular member 10 has a tubular opening 30 extending for the entire length L of member 10, from a first end 32 to a second end 34. It is also seen that ends 32 and 34 have larger cross-sectional diameters than through a middle portion 36, so that either end opening 37 or 38 may be worn on top of the head (as best seen in FIGS. 4, 5, and 6). It is these end areas that are used as the hat portion of the hat and scarf combination garment, while it is the middle portion 36 and the end 37 or 38 not used as the hat portion, that act primarily as the scarf portion of member 10. Securing mechanisms 39 and 40 may be used to fasten the first end 32 to the second end 34 of the garment.

Figure 2:
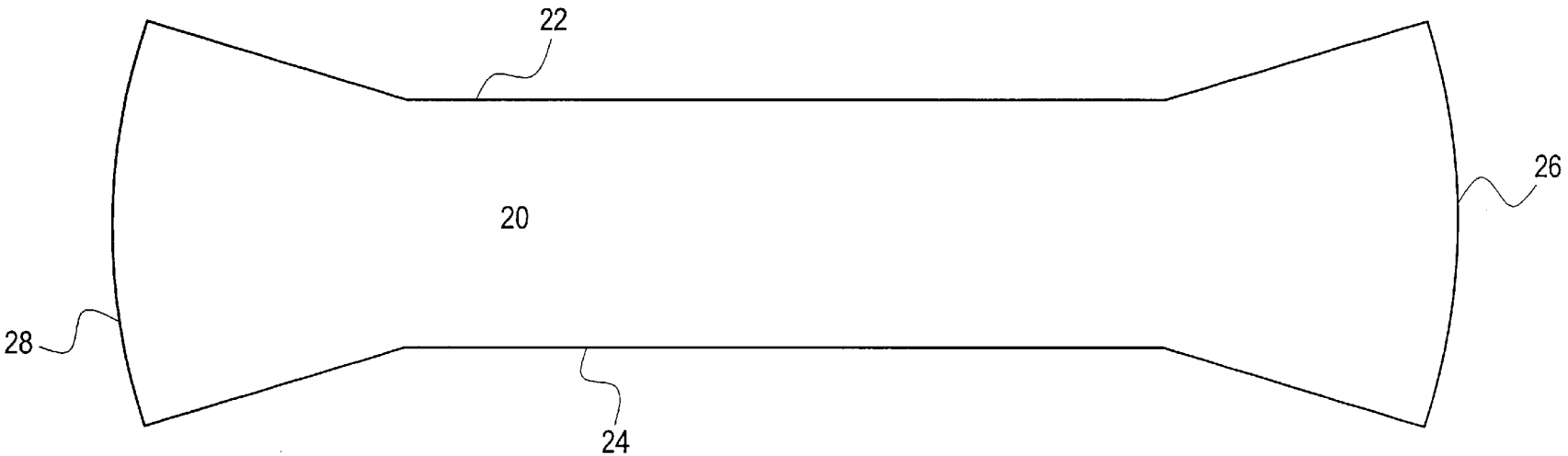
FIG. 2 is a plan view of the embodiment of FIG. 1.

FIG. 2, shows fabric 20 in its flat, pre-tubularly stitched form of FIG. 1. Also shown in FIG. 2 are the length defining edges 22 and 24, upon which in FIG. 1 garment 10 is connected together to form the tubular opening 30. Also shown in FIG. 2 are shorter edges 26 and 28, which extend between edges 22 and 24. It is to be understood that any know manner of connecting edges 22 and 24, are anticipated herein.

Figure 3A:
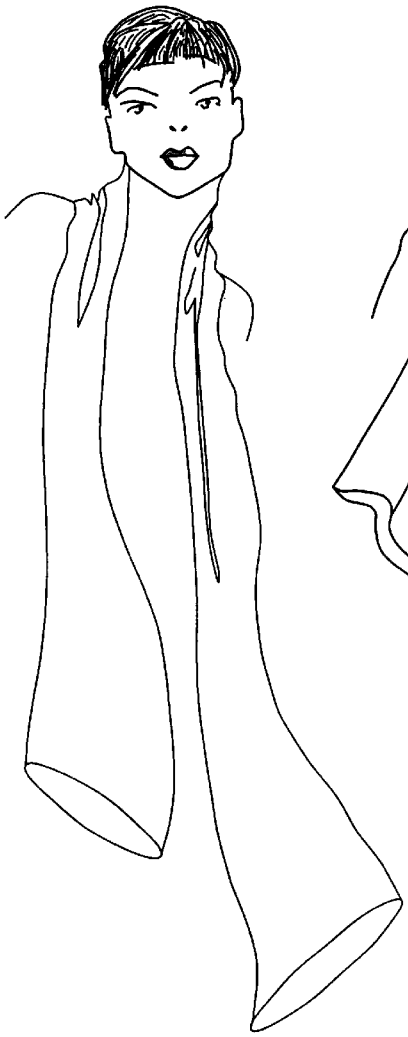
FIGS. 3A and 3B are frontal views of the embodiment on a person worn solely as a traditional scarf.
Figure 3B:
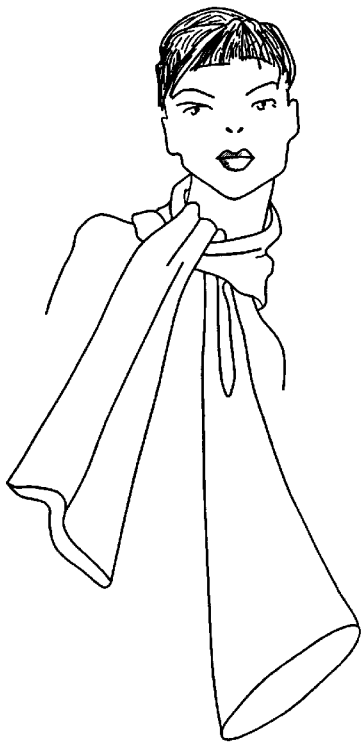

FIGS. 3A and 3B show the hat and scarf combination garment in two of the various ways it may be worn solely as a standard scarf. Note there is no asymmetrical nature or awkward appearance to the garment that makes it obvious or immediately apparent that it is a multi-purpose scarf and hat combination garment.

Figure 7:
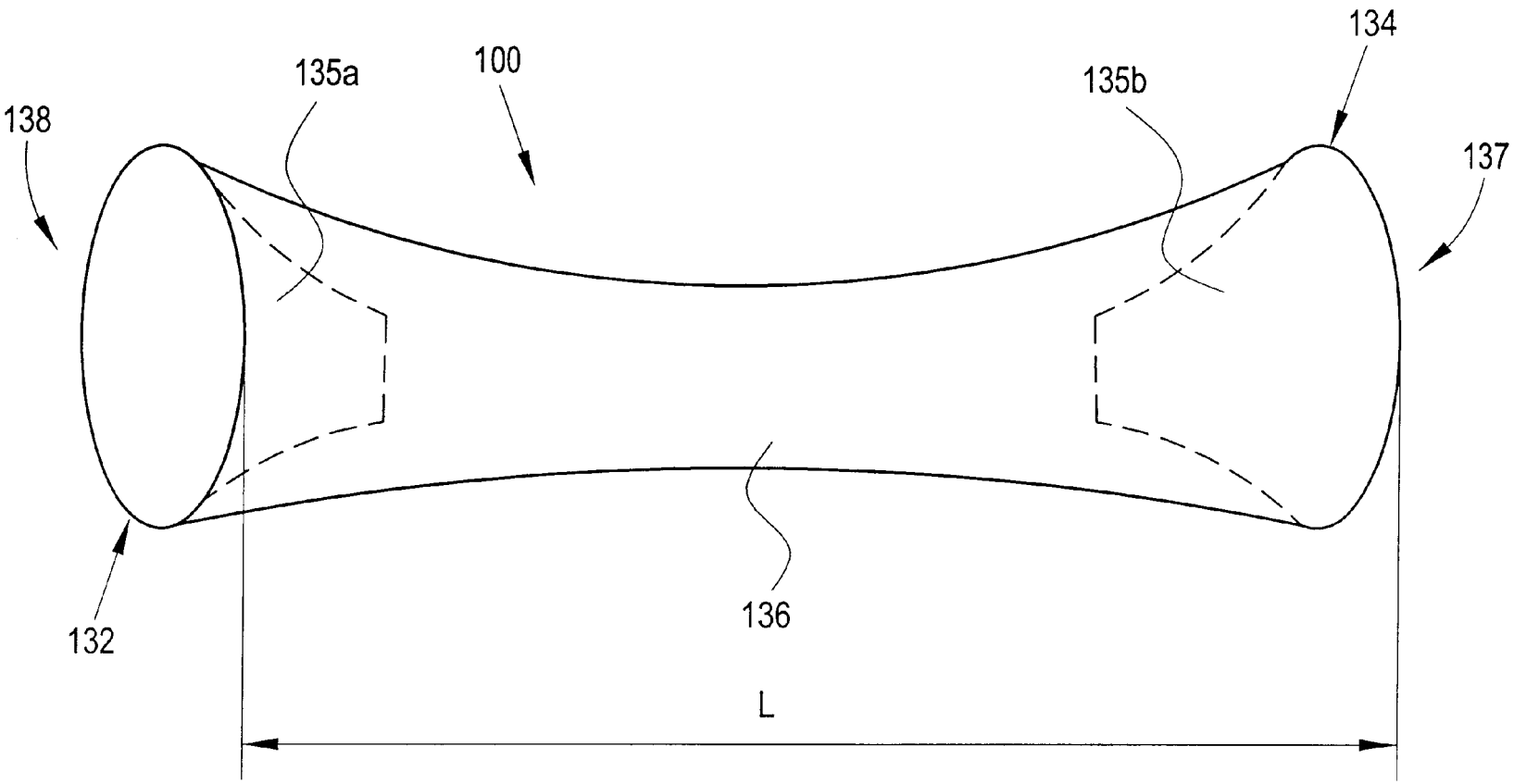
FIG. 7 is a perspective view of another embodiment of the invention.

FIG. 4 shows the garment worn solely as a hat with a long tail. Ends 37 or 38 are sized to be worn over the head, and possibly down to and around the ears, but are not meant to extend down around the neck (as turtleneck or tubular collar). It is portion 36 of the garment that extends downward from the end placed over the top of the head that may be wrapped around the neck, chest and/or face, as shown in FIGS. 5, 6, and 7. It does not matter which end, 37 or 38, is worn over the head as the garment may be worn in either orientation.

FIG. 5 shows the garment worn as a hat and scarf combination covering the head, neck and a portion of the chest.

FIG. 6 shows the garment worn as a hat and scarf combination covering the head, neck, and portions of the face and chest.

FIG. 7 shows another embodiment of the invention, 100, where both ends 137 and 138 contain hat members for insertion of the head, 135*a* and 135*b*, with the middle portion 136 being of solid construction.

In this embodiment, instead of a continuously running tubular opening throughout the entire length L of garment 100, two separate "hat" members 137,138 are formed at the ends 134 and 132, respectively. Connecting hat members 137 and 138, is middle portion 136. Middle portion 136 is not a substantially tubularly formed member, but instead, a regular "solid" type piece of fabric.

Each of the hat members 137,138 has a substantially conically shaped interior 135, into which the person's head will fit. As with the embodiment of FIGS. 1–6, hook and eye connectors 140,142 are used to secure the non head covering end to the head covering end, so as to help prevent flapping and/or unwinding of the end from around the person's neck.

From the foregoing description it is apparent that the spirit and scope of the invention is to have what appears to be a standard scarf with all its inherent variety in wearing options that is likewise a hat and scarf combination. Variations in embodiments may be made within the scope of the invention described above, thus the specifications described serve as illustrations and are not to be construed to limit the scope of the invention

What is claimed is:

1. An adaptable hat and scarf garment of a tubular construction that may be worn solely as a traditional scarf or solely as a hat or as a hat, not a hood, and a scarf combination, comprising:

a fabric member having a length defined by first and second oppositely opposed length defining edges and first and second oppositely opposed shorter edges running between said length defining edges;

an opening through said fabric member, created by the connection of the first defining edge to said second length defining edge;

a first end opening located at a first end of said fabric member, sized for receipt therein of the top of a head;

a second end opening located at a second, opposite end of said fabric member, also sized for receipt therein of the top of said head; and a hook and eye securing mechanism to hold said combination garment in a desired position, with a hook or eye portion secured at a central portion of said first end of said fabric member and a complementary hook or eye portion secured at a central portion of said second end of said fabric member;

wherein said length of said fabric member is such that said fabric member may be worn solely in the manner of a standard scarf;

wherein either of said first or second end openings may be placed over, and worn upon, said top of said head in the manner of a hat; with a remaining portion of said length of said fabric member extending substantially downward from said head, in order to be used in the manner of a scarf.

2. The hat and scarf combination garment of claim 1, wherein said substantially tubular first and second end openings each have a cross-sectional diameter which is larger than a cross-sectional diameter of a middle portion of said substantially tubular fabric member.

3. The hat and scarf combination garment of claim 1, wherein said fabric member may be composed of one of the following: any known textile, synthetic, or natural material, or any combination thereof.

4. An adaptable hat and scarf garment that may be worn solely as a traditional scarf or solely as a hat or as a hat, not a hood, and a scarf combination, comprising:

a fabric member having a length including a flat middle portion disposed between first and second hat members;

said first hat member sized for receipt of a head and located at a first end of said fabric member, said second hat member sized for receipt of a head and located at a second end of said fabric member, a hook and eye securing mechanism to hold said combination garment in a desired position, with a hook or eye portion secured at a central portion of said first end of said fabric member and a complementary hook or eye portion secured at a central portion of said second end of said fabric member;

wherein either of said first or second hat members may be placed over, and worn upon, said top of said head solely in the manner of a hat; with a remaining portion of said length of said fabric member extending substantially downward from said head, in order to be used in the manner of a scarf.

5. The hat and scarf combination garment of claim 4, wherein said fabric member may be composed of one of the following: any known textile, synthetic, or natural material, or any combination thereof.

* * * * *